US005674102A

United States Patent [19]

Lin

[11] Patent Number: 5,674,102

[45] Date of Patent: Oct. 7, 1997

[54] SHAPE-CHANGING FLYING SAUCER

[76] Inventor: Jerome Lin, 2F, No. 180, Sec. 3, Jong Shiaw E. Rd., Taipei, Taiwan

[21] Appl. No.: 738,552

[22] Filed: Oct. 28, 1996

[51] Int. Cl.[6] ..... A63H 27/00

[52] U.S. Cl. ..... 446/46; 473/588

[58] Field of Search ..... 446/34, 36, 46, 446/47, 48, 473; 473/588, 589, 590

[56] References Cited

U.S. PATENT DOCUMENTS

| | | | |
|---|---|---|---|
| 2,835,073 | 5/1958 | Dame | 446/48 |
| 3,955,817 | 5/1976 | Davis | 446/46 X |
| 4,216,962 | 8/1980 | Flemming | 446/46 X |
| 4,737,128 | 4/1988 | Moormann et al. | 446/46 |
| 4,913,675 | 4/1990 | Wilcox | 446/36 |
| 4,955,841 | 9/1990 | Pastrano | 446/46 |

*Primary Examiner*—Robert A. Hafer
*Assistant Examiner*—D. Neal Muir
*Attorney, Agent, or Firm*—Bacon & Thomas

[57] ABSTRACT

A flying saucer including a crossed base frame, four sector blades sliding on the four elongated radial frame sections of the crossed base frame and coupled to one another by a respective slip joint, and an expansible member connected between two sector blades to pull them toward each other. The sector blades are forced radially outwards along the four elongated radial frame sections of the crossed base frame by centrifugal force when the flying saucer is thrown into the air.

3 Claims, 4 Drawing Sheets

SHAPE-CHANGING FLYING SAUCER

BACKGROUND OF THE INVENTION

The present invention relates to flying saucer, and more particularly to a shape-changing flying saucer which changes shape when flying.

Playing flying saucers is a safe and funny sports game popularly accepted by people of different ages. Various flying saucers have been disclosed, and have appeared on the market. Exemplars are seen in Taiwan Pat. Application Nos. 84217821; 84217032; 84103213; 84214674. These flying saucers commonly have a fixed shape that does not change when flying.

SUMMARY OF THE INVENTION

It is one object of the present invention to provide a flying saucer which changes shape when flying. It is another object of the present invention to provide a flying saucer which is detachable. According to one aspect of the present invention, the flying saucer comprises a crossed base frame having a front frame section, a rear frame section, a left frame section, and a right frame section respectively met at the center; a first sector blade coupled to the front frame section of the crossed base frame and moved thereon, the first sector blade comprising a bottom track coupled to the front frame section of the crossed base frame, a hook, a pair of first sliding slots disposed in parallel near one lateral side thereof, and a pair of second sliding slots disposed in parallel near an opposite lateral side thereof; a second sector blade coupled to the rear frame section of the crossed base frame and moved thereon, the second sector blade comprising a bottom track coupled to the rear frame section of the crossed base frame, a hook, a pair of first sliding slots disposed in parallel near one lateral side thereof, and a pair of second sliding slots disposed in parallel near an opposite lateral side thereof; an expansible member connected between the hook of the first sector blade and the hook of the second sector blade; a third sector blade coupled to the left frame section of the crossed base frame and moved thereon, the third sector blade comprising a track coupled to the left frame section of the crossed base frame, a pair of first headed bottom stub rods respectively moved in the first sliding slots of the first sector blade, a pair of second headed bottom stub rods respectively moved in the second sliding slots of the second sector blade; a fourthsector blade coupled to the right frame section of the crossed base frame and moved thereon, the fourth sector blade comprising a track coupled to the right frame section of the crossed base frame, a pair of first headed bottom stub rods respectively moved in the first sliding slots of the second sector blade, a pair of second headed bottom stub rods respectively moved in the second sliding slots of the first sector blade. The sector blades may be injection-molded from plastic, screw members may be used and fastened to the third sector blade and the fourth sector blade to replace the respective headed bottom stub rods.

According to another aspect of the present invention, the expansible member can bean elastic band, an elastic strap, a spring, etc.

According to still another aspect of the present invention, a center hole is made at the center of the crossed base frame, and a decorative cap is fastened to the center hole of the crossed base frame. The cap can be a dome, having a split bottom rod press-fit into the center hole of the crossed base frame. The sector blades of the flying saucer are forced radially outwards along the four elongated radial frame sections of the crossed base frame by centrifugal force when the flying saucer is thrown into the air. Furthermore, the sector blades may be differently colored, or painted with different designs.

DETAILED DESCRIPTION OF THE PREFERRED EMBODIMENT

Figure 1:
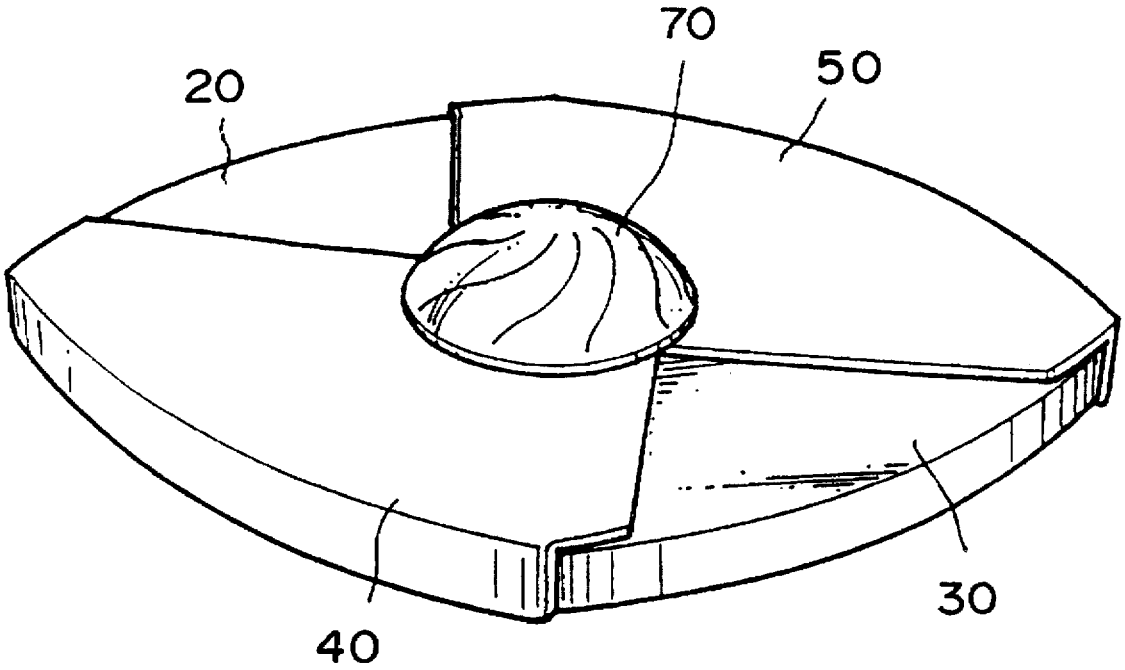
FIG. 1 is an elevational view of a flying saucer according to the present invention.
Figure 2:
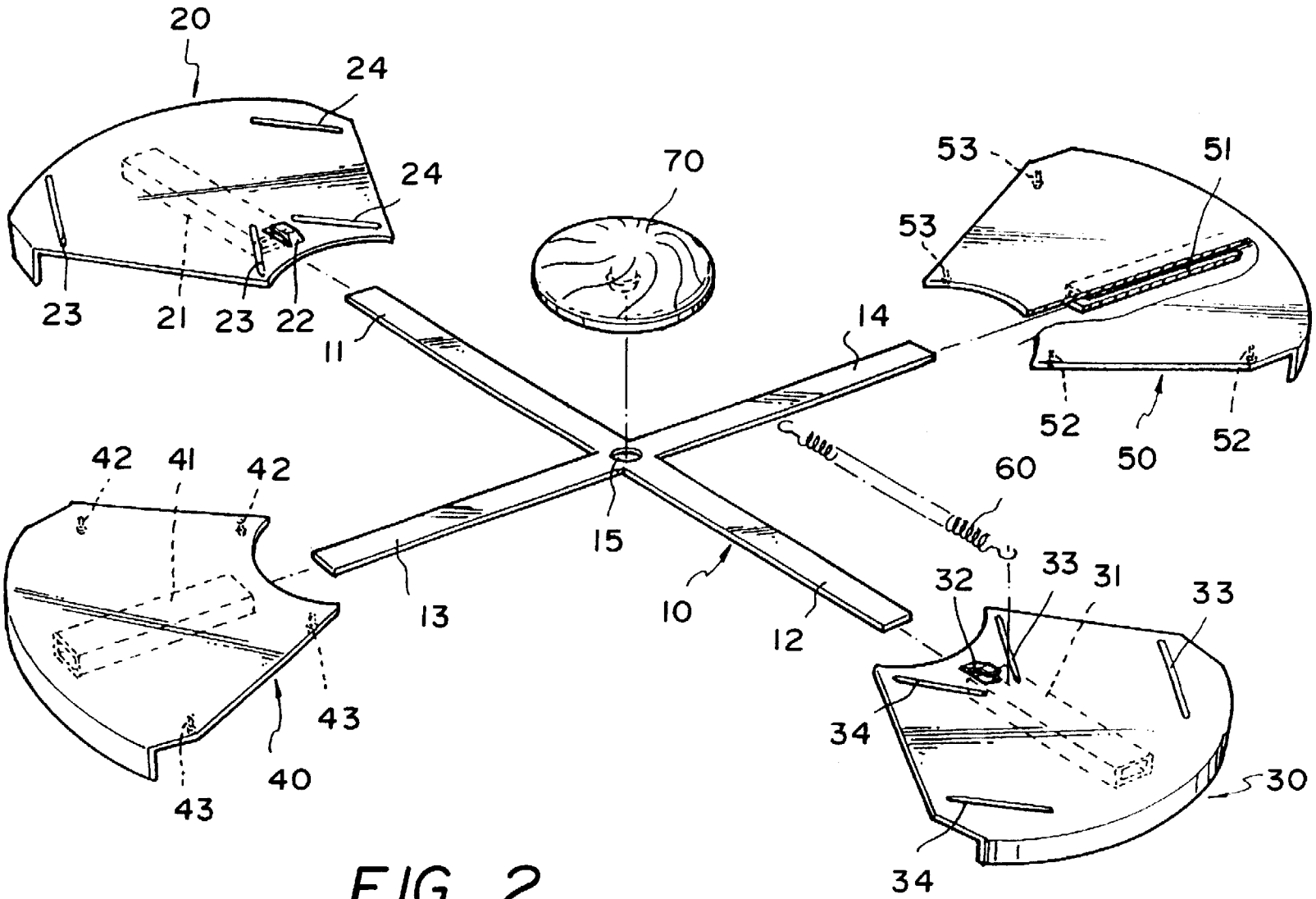
FIG. 2 is an exploded view of the flying saucer shown in FIG. 1.

Referring to FIGS. 1 and 2, a flying saucer in accordance with the present invention, is generally comprised of a crossed base frame 10, a first sector blade 20, a second sector blade 30, a third sector blade 40, a fourth sector blade 50, an expansible member 60, and a cap 70.

The crossed base frame 10 comprises four elongated frame sections, namely, the front frame section 11, the rear frame section 12, the left frame section 13 and the right frame section 14, and a center hole 15 at the center at which the four frame sections meet.

The first sector blade 20 comprises a bottom track 21, a hook 22, a pair of first sliding slots 23 disposed in parallel near the left side, and a pair of second sliding slots 24 disposed in parallel near the right side. The bottom track 21 of the first sector blade 20 is coupled to the front frame section 11 of the crossed base frame 10, permitting the first sector blade 20 to be moved along the front frame section 11 of the crossed base frame 10.

The second sector blade 30 comprises a bottom track 31, a hook 32, a pair of first sliding slots 33 disposed in parallel near the left side, and a pair of second sliding slots 34 disposed in parallel near the right side. The bottom track 31 of the second sector blade 30 is coupled to the rear frame section 12 of the crossed base frame 10, permitting the second sector blade 30 to be moved along the rear frame section 12 of the crossed base frame 10.

The expansible member 60 can be a spring member connected between the hook 22 of the first sector blade 20, and the hook 32 of the second sector blade 30.

The third sector blade 40 comprises a track 41 coupled to the left frame section 13 of the crossed base frame 10 for permitting the third sector blade 30 to be moved along the left frame section 13 of the crossed base frame 10, a pair of first headed stub rods 42 raised from the bottom near the right side and respectively moved in the first sliding slots 23 of the first sector blade 20, a pair of second headed stub rods 43 raised from the bottom near the left side and respectively moved in the second sliding slots 34 of the second sector blade 30.

The fourth sector blade 50 comprises a track 51 coupled to the right frame section 14 of the crossed base frame 10 for permitting the fourth sector blade 50 to be moved along the right frame section 14 of the crossed base frame 10, a pair of first headed stub rods 52 raised from the bottom near the right side and respectively moved in the first sliding slots 33 of the second sector blade 30, a pair of second headed stub rods 53 raised from the bottom near the left side and respectively moved in the second sliding slots 24 of the first sector blade 20.

Figure 5:
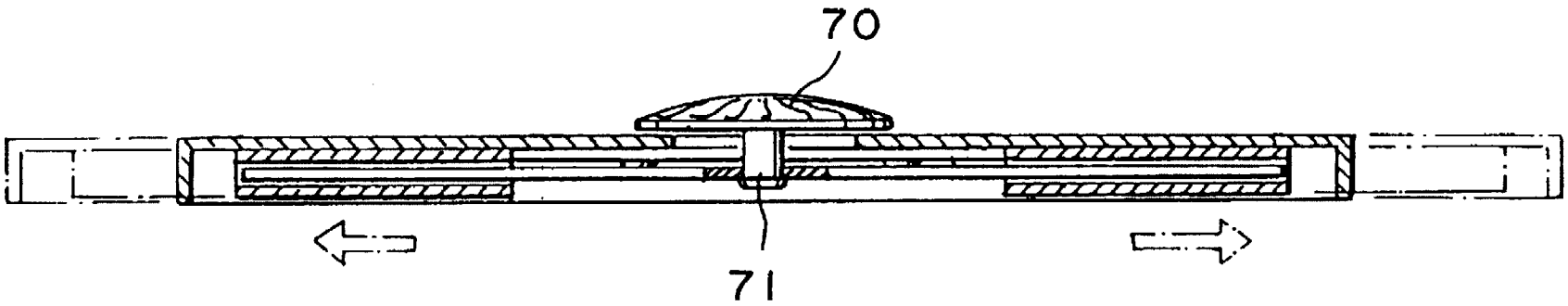

Referring to FIG. 5 and FIG. 1 again, when the sector blades 20, 30, 40, 50 are respectively coupled to the crossed base frame 10, the cap 70 is fastened to the center hole 15 of the crossed base frame 10. As illustrated in FIG. 5, the cap 70 has a split bottom mounting rod 71 press-fit into the center hole 15 of the crossed base frame 10.

Figure 3A:
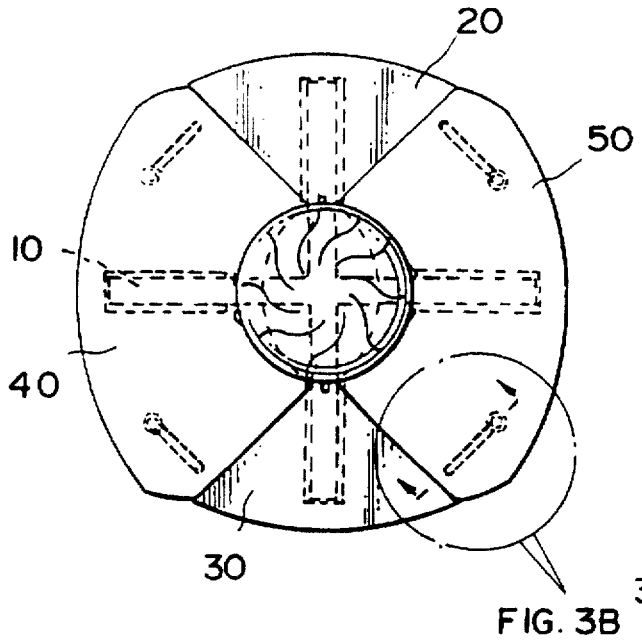
FIG. 3A is a perspective top view of FIG. 1.
Figure 3B:
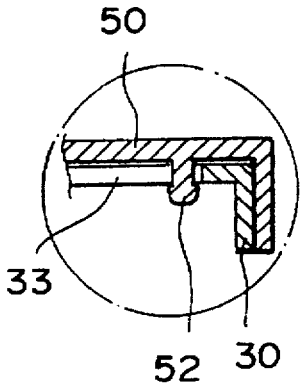
FIG. 3B is an enlarged view of a part of FIG. 3A, showing the headed stub rod of the left sector blade coupled to the corresponding first sliding slot of the second sector blade.

Referring to FIG. 3 and FIG. 1 again, when the flying saucer is assembled, the sector blades 20, 30, 40, 50 are respectively coupled to the crossed base frame 10, the third sector blade 40 and the fourth sector blade 50 are bilaterally and partially overlapped on the first sector blade 20 and the second sector blade 30.

Figure 4:
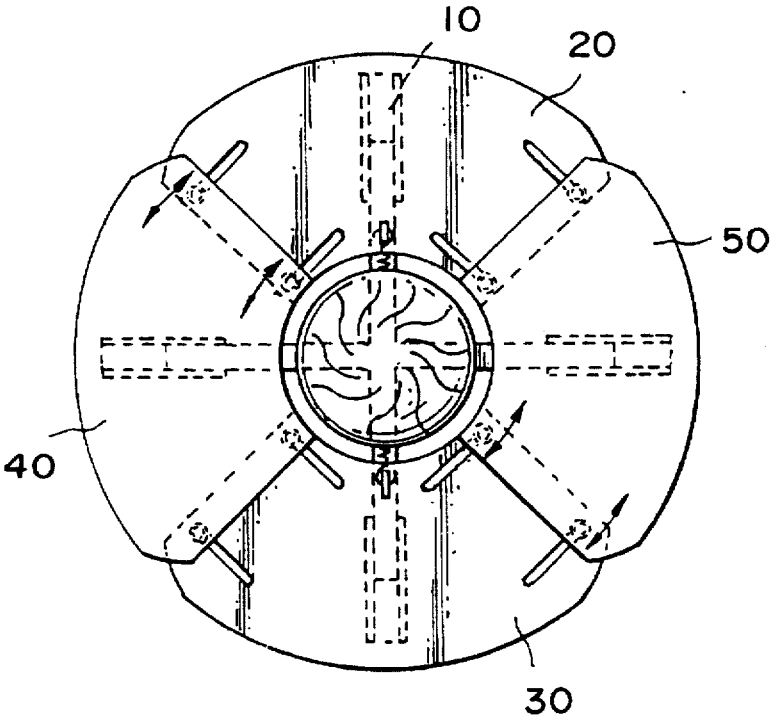
FIG. 4 is similar to FIG. 3A, but showing the sector blades moved relative to one another; and, FIG. 5 is a sectional view of the present invention, showing the sector blades radially extended out.

Referring to FIGS. 4 and 5, when the flying saucer is thrown into the air, the sector blades 20, 30, 40, 50 are forced by centrifugal force to move radially outwards along the frame sections 11, 12, 13, 14 of the crossed base frame 10. When centrifugal force is disappeared, the spring member 60 pulls the first sector blade 20 and the second sector blade 30 toward each other. When the first sector blade 20 and the second sector blade 30 are pulled toward each other, the third sector blade 40 and the fourth sector blade 50 are simultaneously carried toward each other by the first sector blade 20 and the second sector blade 30.

While only one embodiment of the present invention has been shown and described, it will be understood that various modifications and changes could be made thereunto without departing from the spirit and scope of the invention disclosed.

What the invention claimed is:

1. A flying saucer comprising:

a crossed base frame having a front frame section, a rear frame section, a left frame section, and a right frame section respectively met at the center;

a first sector blade coupled to the front frame section of said crossed base frame and moved thereon, said first sector blade comprising a bottom track coupled to the front frame section of said crossed base frame, a hook, a pair of first sliding slots disposed in parallel near one lateral side thereof, and a pair of second sliding slots disposed in parallel near an opposite lateral side thereof;

a second sector blade coupled to the rear frame section of said crossed base frame and moved thereon, said second sector blade comprising a bottom track coupled to the rear frame section of said crossed base frame, a hook, a pair of first sliding slots disposed in parallel near one lateral side thereof, and a pair of second sliding slots disposed in parallel near an opposite lateral side thereof;

an expansible member connected between the bottom hook of said first sector blade and the bottom hook of said second sector blade;

a third sector blade coupled to the left frame section of said crossed base frame and moved thereon, said third sector blade comprising a track coupled to the left frame section of said crossed base frame, a pair of first bottom headed stub rods respectively moved in the first sliding slots of said first sector blade, a pair of second bottom headed stub rods respectively moved in the second sliding slots of said second sector blade; and a fourth sector blade coupled to the right frame section of said crossed base frame and moved thereon, said fourth sector blade comprising a track coupled to the right frame section of said crossed base frame, a pair of first bottom headed stub rods respectively moved in the first sliding slots of said second sector blade, a pair of second bottom headed stub rods respectively moved in the second sliding slots of said first sector blade.

2. The flying saucer of claim 1 wherein said crossed base frame comprises a center hole at the center, and a cap having a bottom mounting rod fastened to said center hole.

3. The flying saucer of claim 1 wherein said expansible member is a spring.

* * * * *